United States Patent [19]

Anderson et al.

[11] Patent Number: 4,713,904

[45] Date of Patent: Dec. 22, 1987

[54] AUTOMATIC CHOKE SHOT GUN

[76] Inventors: Mark S. Anderson, 812 N. 80th Pl., Kansas City, Kans. 66112; George Spector, 233 Broadway, RM 3615, New York, N.Y. 10007

[21] Appl. No.: 874,559

[22] Filed: Jun. 16, 1986

[51] Int. Cl.[4] ..... F41C 21/00

[52] U.S. Cl. ..... 42/79

[58] Field of Search ..... 42/79

[56] References Cited

U.S. PATENT DOCUMENTS

| | | | |
|---|---|---|---|
| 2,453,747 | 11/1948 | Egleson | 42/79 |
| 2,663,961 | 12/1953 | White | 42/79 |
| 2,765,564 | 10/1956 | Schroeder | 42/79 |
| 2,807,903 | 10/1957 | Wheeler | 42/79 |
| 2,869,272 | 1/1959 | Coyle | 42/79 |
| 2,883,782 | 4/1959 | Schroeder | 42/79 |
| 2,989,815 | 6/1961 | Hare | 42/79 |
| 3,797,155 | 3/1974 | Smith et al. | 42/79 |
| 3,831,306 | 8/1974 | Gregg | 42/79 |

*Primary Examiner*—David H. Brown

[57] ABSTRACT

An automatic shotgun choke is provided which is attached to the muzzle of a shotgun barrel and can be adjusted manually by a device mounted within and extending from upper portion of the choke so as to selectively produce a choked and unchoked muzzle. In a modification gas pressure from a fired shell turns fan blades within the choke to operate a choking action upon a charge as it leaves the muzzle.

2 Claims, 5 Drawing Figures

AUTOMATIC CHOKE SHOT GUN

BACKGROUND OF THE INVENTION

The instant invention relates generally to shotgun chokes and more specifically it relates to an automatic shotgun choke.

Numerous shotgun chokes have been provided in prior art that are adapted to control the patterns and power of charges from shotguns. For example, U.S. Pat. Nos. 2,869,272; 3,797,155 and 3,831,306 all are illustrative of such prior art. While these units may be suitable for the particular purpose to which they address, they would not be as suitable for the purposes of the present invention as heretofore described.

SUMMARY OF THE INVENTION

A primary object of the present invention is to provide an automatic shotgun choke that will overcome the shortcomings of the prior art devices.

Another object is to provide an automatic shotgun choke which is attached to the muzzle of a shotgun barrel and can be adjusted manually by a device mounted within and extending from upper portion of the choke so as to selectively produce a choked and an unchoked muzzle.

An additional object is to provide an automatic shotgun choke that uses gas pressure from a fired shell to turn fan blades within the choke to operate a choking action upon a charge as it leaves the muzzle.

A further object is to provide an automatic shotgun choke that is simple and easy to use.

A still further object is to provide an automatic shotgun choke that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
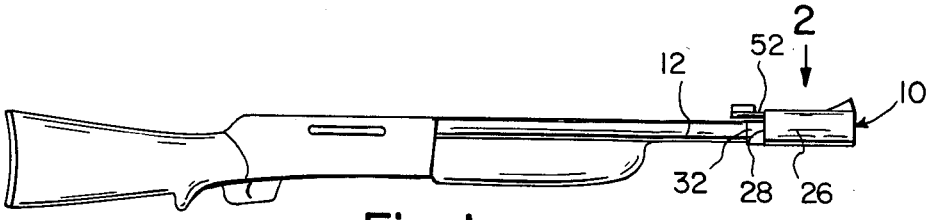
FIG. 1 is a side elevational view of a shotgun with the invention attached thereto.
Figure 2:
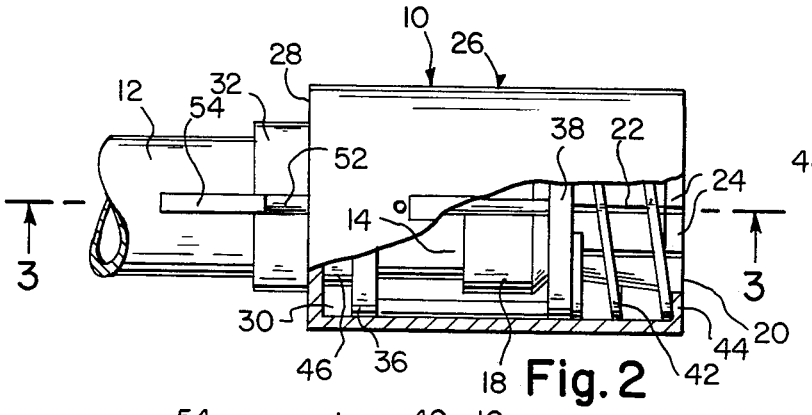
FIG. 2 is a top plan view of the invention with parts broken away as indicated by numeral 2 in FIG. 1.
Figure 4:
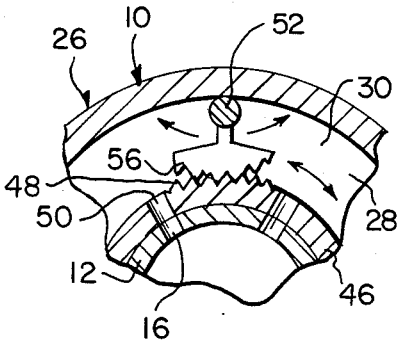
FIG. 4 is an enlarged cross sectional view taken along line 4—4 in FIG. 3 showing the adjustment knob in greater detail.
Figure 3:
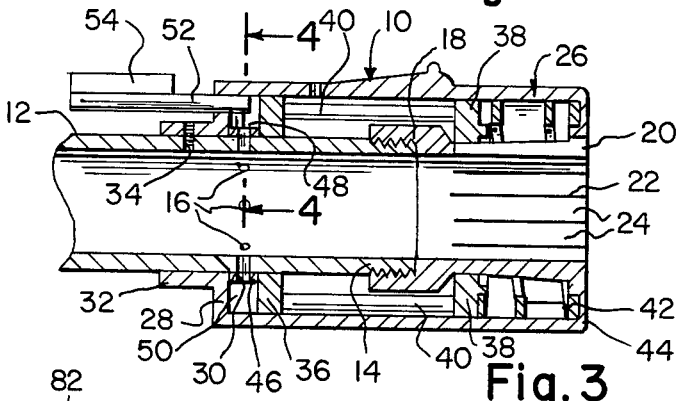
FIG. 3 is a longitudinal cross sectional view taken along line 3—3 in FIG. 2.

Turning now descriptively to the drawings, in which similar reference characters denote similar elements throughout the several views, FIGS. 1 through 4 illustrates an automatic shotgun choke 10. A shotgun barrel 12 has an externally threaded muzzle 14 and circumferentially spaced radially disposed gas ports 16 extended therethrough spaced rearwardly from the muzzle. A collar 18 is threaded on the muzzle 14 of the shotgun barrel 12. The collar 18 has a sleeve 20 with a tapering outer surface extended forwardly therefrom. The sleeve 20 has radially disposed slots 22 extended therethrough providing fingers 24 with the external diameter of the sleeve 20 gradually enlarging from the collar 18 to forward end of the sleeve.

A cylindrical casing 26 surrounds the collar 18 with the sleeve 20 and extends from a point spaced rearwardly from the radially disposed gas ports 16 through the shotgun barrel 12 to a plane corresponding with extended ends of the fingers 24. Rearward end of the casing 26 has an annular web 28 extending from the casing to outer surface of the shotgun barrel 12 providing a closure 30. The web 28 has an annular flange 32 extending rearwardly therefrom. The flange 32 being secured to the shotgun barrel 12 by a set screw 34 for mounting the casing 26 on the shotgun barrel 12.

A piston ring 36 in the casing is slideably mounted on the shotgun barrel 12 and positioned forwardly of the radially disposed gas ports 16 through the shotgun barrel. The piston ring 36 is driven forwardly by pressure of gases of combustion passing through the radially disposed gas ports of the shotgun barrel 12. A choke ring 38 is also positioned in the casing 26 and extends around the fingers 24. Rods 40 connect the choke ring 38 to the piston ring 36 whereby gases of combustion passing through the radially disposed gas ports 16 in the shotgun barrel 12 drive both the piston ring 36 and the choke ring 38 forwardly contracting the fingers 24 of the sleeve 20 which reduces the sleeve. A spring 42 is positioned between the choke ring 38 and forward end of the casing 26 which as an inwardly extended flange 44 against which the spring is seated for urging the piston ring 36 and the choke ring 38 rearwardly of the casing.

A valve ring 46 is provided which has external gear teeth 48 and radial outlet apertures 50 therethrough and is positioned in the casing 26 over the radially disposed gas ports 16 through the shotgun barrel 12. An operating shaft 52 extends rearwardly and outwardly through upper portion of the web 28 of the casing 26. The shaft 52 has a tab 54 at external end and a gear 56 at internal end which mates with the gear teeth 48 of the valve ring 46. When the tab 54 is turned, the shaft 52 turns to revolve the valve ring 46 for adjusting areas of the radially disposed gas ports 16 through the shotgun barrel 12. Shaft 52 preferably may be located at a lower portion of web 28.

Figure 5:
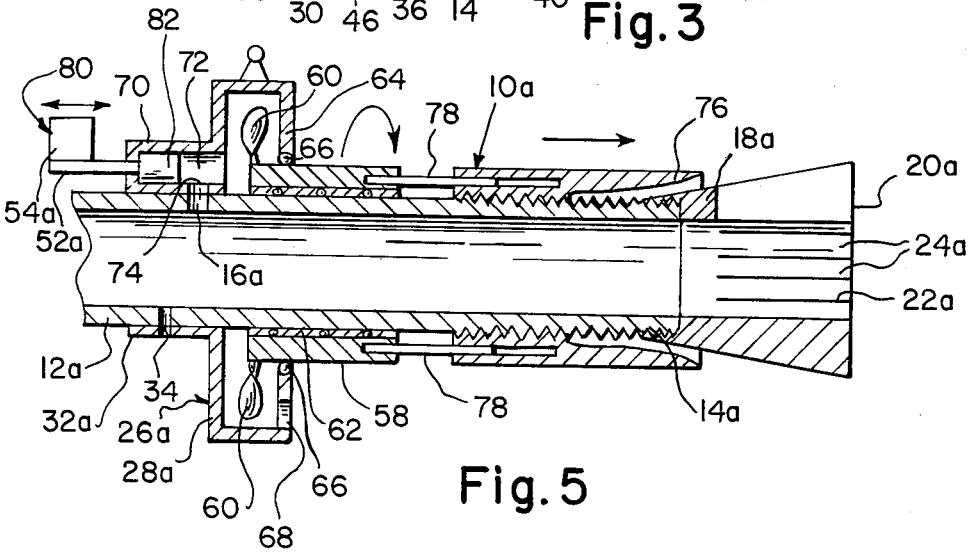
FIG. 5 is a longitudinal cross sectional view similar to FIG. 3 of a modification thereof.

FIG. 5 shows a modified choke **10*a*. A shotgun barrel 12*a* has an externally threaded muzzle 14*a* and a gas port 16*a* extended therethrough spaced rearwardly from the muzzle 14*a*. A collar 18*a* is threaded on the muzzle 14*a* of the shotgun barrel 12*a*. The collar has a sleeve 20*a* with a tapering outer surface extended forwardly therefrom. The sleeve 20*a* has radially disposed slots 22*a* extended therethrough providing fingers 24*a* with diameter of the sleeve 20*a* gradually enlarging from the collar 18*a*** to forward end of the sleeve.

A gas operated ring 58 has radially disposed fan blades 60 extending therefrom. The gas ring 58 is rotatably mounted with bearings 62 on the shotgun barrel **12*a* between the gas port 16*a* and the muzzle 14*a*. A cylindrical casing 26*a* surrounds the fan blades 60 of the gas ring 58. Rearward end of the casing 26*a* has a first annular web 28*a* extending from the casing to outer surface of the shotgun barrel 12*a*. The first web 28*a* has an annular flange 32*a*** extending rearwardly therefrom.

The flange 32a is secured to the shotgun barrel 12a by a set screw 34 for mounting the casing 26a on the shotgun barrel. The casing 26a has a second annular web 64 extending from the casing to outer surface of the gas ring 58. The second annular web 64 has an annular sealing member 66 and a lower exit port 68.

A vent rib 70 has a gas tube 72 within and an inlet port 74 therethrough formed on upper portion of the flange 32a of the casing 26a. The inlet port 74 is positioned over the gas port 16a through the shotgun barrel 12a. The vent rib 70 extends into the first annular web 28a to allow pressure of gases of combustion to pass through the gas port of the shotgun barrel to rotate the fan blades 60. Gases then leave the exit port 68.

A choke cylinder 76 is threaded on the muzzle 14a of the shotgun barrel 12a rearwardly of the collar 18a. Telescopic rods 78 connect the gas ring 58 to the choke cylinder 76 whereby gases of combustion passing through the casing 26a will turn the gas ring 58 to drive the choke cylinder 76 forwardly contracting the fingers 24a of the sleeve 20a which reduces the sleeve.

A device 80 is provided for adjusting area of the gas port 16a through the shotgun barrel 12a. The device consists of an operating shaft 52a which extends rearwardly and outwardly through the vent rib 70. The shaft 52a has a tab 54a at external end and a piston head 82 at internal end which slides within the gas tube 72. When the tab 54a is pushed in the shaft 52a will move inwardly to place the piston head 82 over the inlet port 74 for adjusting area of the gas port 16a through the shotgun barrel 12a.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An automatic shotgun choke which comprises:

(a) a shotgun barrel having an externally threaded muzzle and circumferentially spaced radially disposed gas ports extended therethrough spaced rearwardly from said muzzle;

(b) a collar threaded on said muzzle of said shotgun barrel, said collar having a choke sleeve with a tapering outer surface extended forwardly therefrom, said sleeve having radially disposed slots extended therethrough providing fingers with the outer diameter of said sleeve gradually enlarging from said collar to forward end of said sleeve;

(c) a choke assembly mounted on said muzzle, said assembly extending from a point rearwardly of said radially disposed gas ports through said shotgun barrel to said fingers, a rearward end of said assembly having an annular portion mounted on the outer surface of said shotgun barrel providing a gas chamber having exhaust holes, said portion having an annular flange extended rearwardly therefrom, said flange being secured to said shotgun barrel;

(d) a gas operated member in said chamber moveably mounted on said shotgun barrel and positioned forwardly of said radially disposed gas ports through said shotgun barrel, said gas operated member being activated by pressure of gases of combustion passing through said radially disposed gas ports of said shotgun barrel;

(e) a choke ring forming part of said choke assembly extending partially around said fingers;

(f) means connecting said choke ring to said gas operated member whereby gases of combustion passing through said radially disposed gas ports in said shotgun barrel actuate said member causing said choke ring to move forward thereby constricting said fingers of said sleeve;

(g) means for adjusting the gas port size comprising a valve member slidable over said ports having an external operation shaft extending into said chamber for adjusting said valve, wherein (h) said gas operated member having radially disposed fan blades extended therefrom and said member being rotatably mounted on said shotgun barrel;

(i) wherein said choke assembly surrounds said fan blades of said member and has a first annular web having an annular sealing member extending to the outer surface of said shotgun barrel;

(j) said portion including a vent rib having inlet ports therethrough formed on upper portion of said flange, said inlet ports positioned over said gas ports with said vent rib communicating with said chamber to allow pressure of gases of combustion to pass through said gas ports of said shotgun barrel to rotate said fan blades then leave through said exit ports;

(k) said choke ring being threaded on said muzzle of said shotgun barrel rearwardly of said collar; and (l) said gas operated member including telescopic rods connecting said gas operated member to said choke ring whereby gases of combustion passing through said casing will turn said member to rotatably drive said choke ring forwardly contracting said fingers of said sleeve.

2. An automatic shotgun as recited in claim 1, wherein said adjusting means comprises an operating shaft which extends rearwardly and outwardly through said vent rib said shaft having a tab at external end and a piston head at internal end which slides within said rib so that when said tab is pushed in, said shaft will move inwardly to place said piston head over said inlet port for adjusting area of said gas port through said shotgun barrel.

* * * * *